US011203172B2

(12) United States Patent
Fauconneau

(10) Patent No.: US 11,203,172 B2
(45) Date of Patent: Dec. 21, 2021

(54) METHOD OF ALIGNING AN UPPER AND A LOWER CHANGEABLE TOOL, AND DEVICE FOR PROCESSING WORKPIECE SHEETS

(71) Applicant: BOBST MEX SA, Mex (CH)

(72) Inventor: Olivier Fauconneau, Lausanne (CH)

(73) Assignee: BOBST MEX SA

( * ) Notice: Subject to any disclaimer, the term of this patent is extended or adjusted under 35 U.S.C. 154(b) by 262 days.

(21) Appl. No.: 16/097,398

(22) PCT Filed: May 3, 2017

(86) PCT No.: PCT/EP2017/025103
§ 371 (c)(1),
(2) Date: Oct. 29, 2018

(87) PCT Pub. No.: WO2017/194197
PCT Pub. Date: Nov. 16, 2017

(65) Prior Publication Data

US 2019/0143626 A1 May 16, 2019

(30) Foreign Application Priority Data

May 13, 2016 (DE) ..... 10 2016 108 968.0

(51) Int. Cl.
*B31B 50/00* (2017.01)
*B31B 50/14* (2017.01)
(Continued)

(52) U.S. Cl.
CPC ..... *B31B 50/006* (2017.08); *B26D 5/007* (2013.01); *B26F 1/40* (2013.01); *B31B 50/044* (2017.08);
(Continued)

(58) Field of Classification Search
CPC ... B31B 50/006; B31B 50/002; B31B 50/044; B31B 50/442; B31B 50/54; B31B 50/59;
(Continued)

(56) References Cited

U.S. PATENT DOCUMENTS 5,402,698 A * 4/1995 Morrison ..... B26D 7/2628 225/97
5,784,939 A * 7/1998 Rebeaud ..... B26D 7/2614 83/563
(Continued)

FOREIGN PATENT DOCUMENTS

JP 2004268175 A * 9/2004 ..... B26F 1/40

OTHER PUBLICATIONS

International Search Report dated Sep. 11, 2017 in corresponding PCT International Application No. PCT/EP2017/025103.
(Continued)

*Primary Examiner* — Hemant Desai
*Assistant Examiner* — Jacob A Smith
(74) *Attorney, Agent, or Firm* — Ostrolenk Faber LLP

(57) ABSTRACT

In a method of aligning an upper and a lower changeable tool (2, 10, 18) in a device for processing, e.g., sheets of paper, provision is made that with the aid of at least one digital camera (50, 51), the upper changeable tool (2) is aligned with a sheet that has been moved in and the lower changeable tool (18) is aligned relative to the upper changeable tool (2) after the sheet has been moved out.

18 Claims, 4 Drawing Sheets

(51) Int. Cl.

| | |
|---|---|
| ***B31B 50/20*** | (2017.01) |
| ***B31B 50/28*** | (2017.01) |
| ***B31B 50/04*** | (2017.01) |
| ***B26F 1/40*** | (2006.01) |
| ***B26D 5/00*** | (2006.01) |
| ***B31B 50/88*** | (2017.01) |
| *B26F 1/44* | (2006.01) |
| *B31B 50/62* | (2017.01) |
| *B31B 100/00* | (2017.01) |
| *B31B 120/70* | (2017.01) |
| *B31B 50/26* | (2017.01) |

(52) U.S. Cl.
CPC ..... *B31B 50/14* (2017.08); *B31B 50/142* (2017.08); *B31B 50/20* (2017.08); *B31B 50/88* (2017.08); *B26F 2001/4463* (2013.01); *B31B 50/26* (2017.08); *B31B 50/62* (2017.08); *B31B 2100/00* (2017.08); *B31B 2120/70* (2017.08)

(58) Field of Classification Search
CPC ..... B31B 50/592; B31B 50/14; B31B 50/20; B31B 50/26; B31B 50/62; B31B 50/88; B31B 50/142; B31B 2100/00; B31B 2120/70; B26D 5/00; B26D 5/02; B26D 5/06; B26D 7/26; B26D 7/1818; B26D 2007/2607; B26F 1/40; B41F 19/02; B41F 19/064
USPC ..... 493/8, 11, 13, 16, 17, 34, 55, 58, 59, 493/128, 143, 372, 379, 468, 475
See application file for complete search history.

(56) References Cited

U.S. PATENT DOCUMENTS

| | | | | |
|---|---|---|---|---|
| 5,822,208 | A * | 10/1998 | Bory | G01N 21/88 700/108 |
| 6,477,930 | B1 * | 11/2002 | Sandford | B26D 7/1818 83/162 |
| 7,955,245 | B2 * | 6/2011 | Cheich | B31D 5/0052 493/464 |
| 8,073,239 | B1 * | 12/2011 | Bahrami | G06T 7/001 382/143 |
| 8,926,485 | B2 * | 1/2015 | Diehr | B41J 3/32 493/16 |
| 8,926,486 | B2 * | 1/2015 | Diehr | B44B 5/00 493/468 |
| 2001/0042451 | A1 * | 11/2001 | Dompierre | B26D 7/1818 100/94 |
| 2012/0053036 | A1 * | 3/2012 | Bruns | B31B 50/00 493/128 |
| 2012/0202664 | A1 * | 8/2012 | Brown | A61F 13/15772 493/8 |
| 2013/0165310 | A1 * | 6/2013 | Barrer | B65H 45/30 493/468 |
| 2013/0235139 | A1 * | 9/2013 | Schnabel | B41J 11/42 347/104 |
| 2014/0121088 | A1 * | 5/2014 | Schindler, II | G03G 15/224 493/129 |
| 2016/0130106 | A1 * | 5/2016 | Schneider | B65H 35/04 156/64 |

OTHER PUBLICATIONS

Written Opinion dated Sep. 11, 2017 in corresponding PCT International Application No. PCT/EP2017/025103.

* cited by examiner

METHOD OF ALIGNING AN UPPER AND A LOWER CHANGEABLE TOOL, AND DEVICE FOR PROCESSING WORKPIECE SHEETS

CROSS-REFERENCE TO RELATED APPLICATIONS

The present application is a 35 U.S.C. §§ 371 national phase conversion of PCT/EP2017/025103, filed May 3, 2017, which claims priority of German Patent Application No. 10 2016 108 968.0, filed May 13, 2016, the contents of which are incorporated by reference herein. The PCT International Application was published in the English language.

TECHNICAL FIELD

The invention relates to a method of aligning an upper and a lower changeable tool in a device for processing workpiece sheets, in particular of paper, cardboard or plastic for packaging. The invention further relates to a device for processing the aforesaid workpiece sheets.

TECHNICAL BACKGROUND

Such sheets of paper, cardboard (including corrugated board) or plastic are further processed in several steps, in particular for packaging. For example, a plurality of blanks on the same sheet are die-cut and subsequently separated in a flat bed die-cutting press with an adjoining flat bed stripping device. The stripping device comprises a station in which the so-called "waste" is detached from the sheet, and a subsequent station referred to as a blank separation station, in which the individual blanks are pushed out of the sheet and placed on a pile. In a further device which is referred to as a folder-gluer, the blanks are folded and glued in sections so as to produce a sturdy box.

The method according to the invention and the device according to the invention relate not only to the above flat bed die-cutting presses and flat bed stripping or blanking devices, but also to a printing machine by means of which the sheets of paper, cardboard or plastic are printed or laminated, as well as to devices in which the sheets are embossed in order to generate creases in the later blanks for the creasing process.

These devices have the problem in common that for each kind of packaging, a dedicated tool has to be manufactured, referred to as a "changeable tool" below. For flat bed die-cutting devices, these tools are plates which have cutting knives or pressure pads attached thereto; for flat bed stripping devices, these are pins and pressure pads by means of which the waste or the blank is separated from the sheet. This means that such devices include an upper and a lower changeable tool, which simultaneously act on the sheet to be processed.

In a flat bed stripping device, for example, the following steps are carried out for aligning the upper and lower changeable tools. First, the lower changeable tool is inserted into the device, then a sheet that passes through the device and was cut in the preceding die-cutting station is transported into the stripping station and stopped there. The cut sections are then separated from the sheet in order to set the positions of the openings in the lower changeable tool through which the cut-out parts then have to be moved, in relation to the cutting edges. Finally, the upper tool is inserted and aligned so as to correspond to the lower tool. For this alignment process, an operator in some cases needs to step into the device for inspecting the different positions of the parts in relation to each other, partly from above and from below. This is time-consuming and strenuous.

The changeable tools, especially for stripping and separating, always must be exactly adapted to the pressure applied and aligned with the edges of cut in the preceding station. If upper and lower changeable tools are provided, as is the case in the die-cutting or stripping processes, for example, these tools further need to be precisely aligned with each other. The alignment is effected manually by adjusting the holders, located on the device side, for the changeable tools in the X- and Y-directions and also in the direction of rotation in a plane parallel to the plane of the sheets supplied, by means of spindles, gearwheels and manually drivable wheels. The individual positions of the holders are ascertained in that the positions of parts of the adjustment means or of the holders are ascertained and permanently measured during the setting process. For this purpose, mechanical or mechanical-digital position indicators are employed, which detect and indicate the positions of adjustable parts of the holders or of the adjustment means coupled to them. The operator first has to do a test run of the device upon setting and then readjust it intuitively on the basis of the production results. This process may take an experienced operator roughly 20 minutes. Since several different sheets are processed in the course of one day, the device has to be set up several times each day, which results in a considerable loss of production. To minimize such loss of production, the optimum setting parameters are noted down on the tools, and the tools are provided with respective sticky labels and archived with them. In the case of a reinstallation, the holder then only needs to be set to the previously determined positions, as in a coordinate system. This provides for a substantial gain in time.

SUMMARY OF THE INVENTION

The object of the present invention consists in providing an improved method of aligning an upper and a lower changeable tool in a device for processing workpiece sheets, in particular of paper, cardboard or plastic for packaging, and also a device for processing workpiece sheets which allows a faster and easier alignment of the changeable tools with each other.

The method according to the invention is characterized by the following steps:

providing at least one digital camera, inserting the lower changeable tool into a holder on the device side, moving a sheet into the device until it lies above the lower changeable tool, inserting the upper changeable tool into a holder on the device side, aligning the upper changeable tool in relation to the sheet with the aid of the at least one camera, removing the sheet, and aligning the lower changeable tool in relation to the upper changeable tool with the aid of the at least one camera.

First it should be emphasized that although the above-mentioned order is advantageous, the above steps need not necessarily be carried out in this order. For example, insertion of both the upper and lower changeable tools may be completed before the sheet is moved into the device.

The method according to the invention renders it unnecessary to enter the machine in order to detect the positions of the changeable tools relative to each other and to the sheet to readjust them thereafter. All of the setting work can be performed from outside, which is significantly faster and, in addition, physically less strenuous for the operator. The positions of the parts to be aligned with each other are captured by the at least one digital camera, so that, furthermore, it is also no longer necessary to illuminate those sections of the device that are difficult to access, in order to see the parts to be aligned. Digital cameras have an excellent luminous intensity, rendering this effort that was previously involved also unnecessary.

The at least one camera is preferably introduced into the device temporarily for alignment purposes and is removed again from the device after the alignment. This has the advantage that any dust that is released during the manufacturing process will not soil the camera. Further, the cameras are possibly received on moving parts, which might put too much strain on the cables of the cameras in the long run. But it is, of course, entirely possible to fasten the cameras in the device permanently, for instance to non-moving parts in order to overcome the above-mentioned drawbacks.

Just one camera may be sufficient to detect the position of the upper changeable tool in relation to the sheet and of the upper changeable tool in relation to the lower changeable tool. In this connection, it has to be made sure that the alignment within a plane parallel to the sheet has to be effected in all directions, including a direction of rotation, so that for an increased accuracy, the reference points made use of for detecting the positions should be points of the changeable tools and of the sheet that are located as far apart from each other as possible. The alignment accuracy is improved as the lateral distance of, for example, two points that are remote from each other increases.

If the accessibility or the detection range of the camera is not sufficient, it is useful to employ a plurality of cameras. Here, one camera may, for example, cover the front edge area of the lower changeable tool in the feed direction of the sheet and a further camera may cover the rear area of the changeable tool.

As far as the position of the at least one camera is concerned, tests have shown that further positions are also advantageous. For example, the camera may be attached to the device so as to be spatially fixed and remote from the changeable tools such that it covers and detects the upper changeable tool. It is not required here for the camera to have the entire changeable tool in its viewing range; a relevant portion is sufficient. The camera can be permanently fixed within the processing device or can be mounted thereto only for the alignment process and can be removed thereof after alignment.

The at least one camera can be attached to a retainer which allows displacement and alignment of the camera with respect to the upper changeable tool.

Further, the camera may sense an opening in the upper changeable tool to determine the position of the upper changeable tool and may sense the lower changeable tool through said opening for alignment the upper and the lower changeable tools with respect to each other.

As an alternative hereto, the at least one camera may even be fastened to the upper changeable tool itself; for example, it may be releasably inserted in a form-fitting seat for the particular camera. In this case, it is not the upper changeable tool that is captured by the camera, but, rather, the upper changeable tool constitutes the coordinate basis for the camera. The camera is usually removed after the alignment process.

The alignment process may be accelerated yet again if the lower changeable tool has at least one mark that is adapted to be detected by the at least one camera, in particular two marks remote from each other and adapted to be detected by one or by two cameras. The mark or marks symbolize(s) the target position of the lower changeable tool aligned with the upper changeable tool. For example, the changeable tools have already been perfectly aligned with each other outside the device. In this perfect alignment position (target position), a mark is then permanently applied to the lower changeable tool, for instance an alignment cross is burnt in. The same may also be performed for the upper changeable tool. For a perfect alignment in the device, the respective alignment tool then has to be precisely adjusted with the aid of the camera such that the mark moves into the predefined focus.

The upper changeable tool is usually aligned in relation to the sheet with the aid of marks provided on the sheet or edges, in particular edges of cut, produced on the sheet. These edges of cut are generated in a die-cutting station, for example, and in the subsequent stripping station the corresponding upper and lower changeable tools need to be in precise alignment with the previously produced edges of cut. Alternatively to this, it is however sufficient to provide marks on the sheet which serve for alignment. This is sufficient when the position of the sheet in the preceding processing station in relation to the tool there is known. Furthermore, for example when a sheet is printed, the position of the mark relative to the printed areas is predefined and always fixed due to the mark applied during printing, so that the mark can serve as a reference point for alignment for the subsequent die-cutting or stripping.

The alignment may be effected with the aid of a display device in the form of a screen that is coupled to the at least one camera and reproduces the image captured by the at least one camera.

An electronic mark added to the camera image may be loaded into the screen and represents the current camera orientation. For example, an alignment cross is loaded in the center of the camera image here, the alignment cross precisely representing the center of the camera image and the orientation of the camera. A cross as a mark on the sheet or on the lower changeable tool must then be aligned with this inserted cross so as to realize a perfect positioning.

The aligning may be performed manually either exclusively by means of the screen, i.e. the operator uses adjustment means for the holders and changes them manually while looking at the screen. Alternatively, this manual alignment may also be performed in that, additionally, digital sensor units are employed which are electronically coupled to the control unit of the device and determine the positions of parts that move during the setting of the associated changeable tool. These moving parts may be parts of the holder or parts of the adjustment means. The control unit identifies the alignment error on the basis of the image information received from the at least one camera. Display devices in the form of displays which are integrated in the sensor units are driven by the control unit such that they output data relating to the current misalignment and/or the target position. This has the advantage that it is not absolutely necessary for the operator to stand in front of the central screen during the alignment process, from where he/she may possibly not be able to manually reach the adjustment means. Owing to the displays on the sensor units which are usually mounted directly to the adjustment means, the operator will immediately see all current data that were obtained by means of the camera and processed by the control unit, so that the fine adjustment may be performed immediately. The display indicates the target position or the actual position, for example, or indicates in which direction the adjustment means has to be actuated, or indicates the distance from the target position.

As an alternative hereto, the aligning may proceed fully automatically, the control unit activating motors for adjusting the changeable tools in order to bring the changeable tools into the target position. The control unit calculates the data on the basis of information which is made available to the control unit by the at least one camera. In this case, it is not absolutely necessary to provide display devices.

The method according to the invention is applicable to flat bed die-cutting devices, flat bed stripping or blanking devices, embossing devices or sheet printing devices.

The above object is also achieved by a device for processing workpiece sheets, in particular for the processing of sheets of paper, cardboard or plastic for packaging. The device according to the invention comprises a processing station through which the workpiece sheets are transported in succession, respective upper and lower changeable tools that are specific to the processing of the sheets, the changeable tools being adapted to be fastened to holders on the device side and adapted to be aligned with each other, a central electronic control unit for controlling the device, at least one digital camera which is coupled to the control unit and is mounted in the processing station such that when the sheet has been moved in, the camera can optically detect the sheet and, when the sheet has been moved out, it can optically detect the lower changeable tool, and adjustment means for independently aligning the upper and lower changeable tools with each other.

The device according to the invention is provided in particular for carrying out the method according to the invention.

As discussed above with reference to the method described, the adjustment means may be a manual or a motor-driven adjustment means. The motor-driven adjustment means is coupled to the control unit and, after the misalignment has been detected, it is able to bring the associated changeable tool into the target position.

Preferably, at least one display device is provided which reproduces the current alignment of the sheet that has been moved in, relative to the upper changeable tool and, when the sheet has been moved out, reproduces the alignment of the lower changeable tool relative to the upper changeable tool.

The display device may include a screen for reproducing the camera image(s), and/or displays provided on sensor units of the adjustment means, the control unit being configured to reproduce information about the current position and/or the relation between the current position and the target position.

The upper changeable tool may include, for the at least one camera, a seat for temporary insertion of the associated camera, and the lower changeable tool may include at least one mark that is detectable by the at least one camera. This mark symbolizes the perfect target position of the lower changeable tool aligned in relation to the upper changeable tool, as described above with reference to the method according to the invention.

Alternatively or additionally to the manual alignment, provision may also be made for a completely autonomous self-alignment. To this end, the control unit is configured to automatically align the holders on the basis of the data received from the at least one camera.

Further features and advantages of the invention will be apparent from the description below and from the accompanying drawings, to which reference is made and in which:

DESCRIPTION OF AN EMBODIMENT

Figure 1:
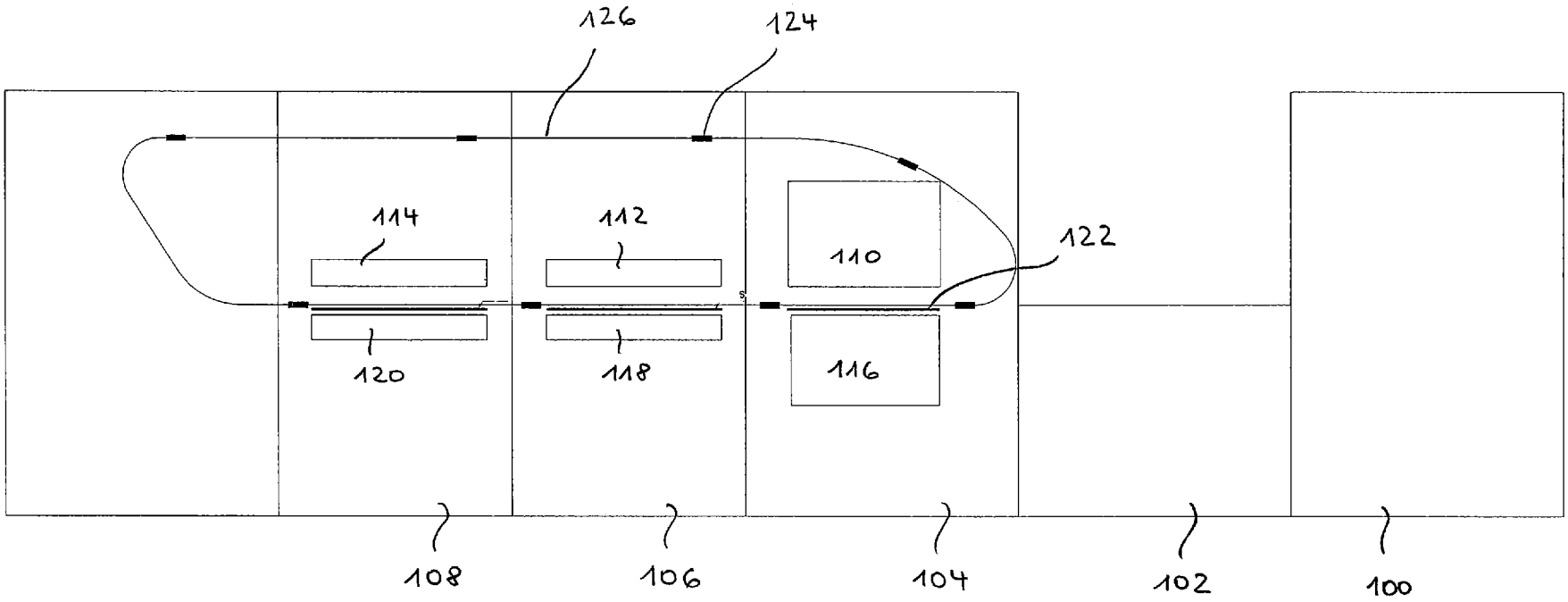
FIG. 1 shows a side view of a flat bed die-cutter which includes several devices according to the invention in the form of several stations.

FIG. 1 shows a flat bed die-cutting press for processing workpiece sheets made of paper, cardboard including corrugated board, and plastic.

The flat bed die-cutting press has a plurality of devices, also referred to as stations, through which the sheets that are fed in pass in succession.

The flat bed die-cutting press comprises a so-called feeder 100, in which the sheets, stacked on one another, are introduced, an adjoining separator 102, in which the sheets are supplied to the subsequent stations of the flat bed die-cutting press one after the other, a cutting or embossing device 104, a stripping device 106, in which waste is separated from the sheet, and a blank separation device 108, in which the blanks are separated from the sheet. The devices 104-108 each have so-called upper and lower changeable tools 110-114 and 116-120, respectively, provided therein, which are aligned with each other in pairs to process sheets 122 located between them when they are closed.

Figure 2:
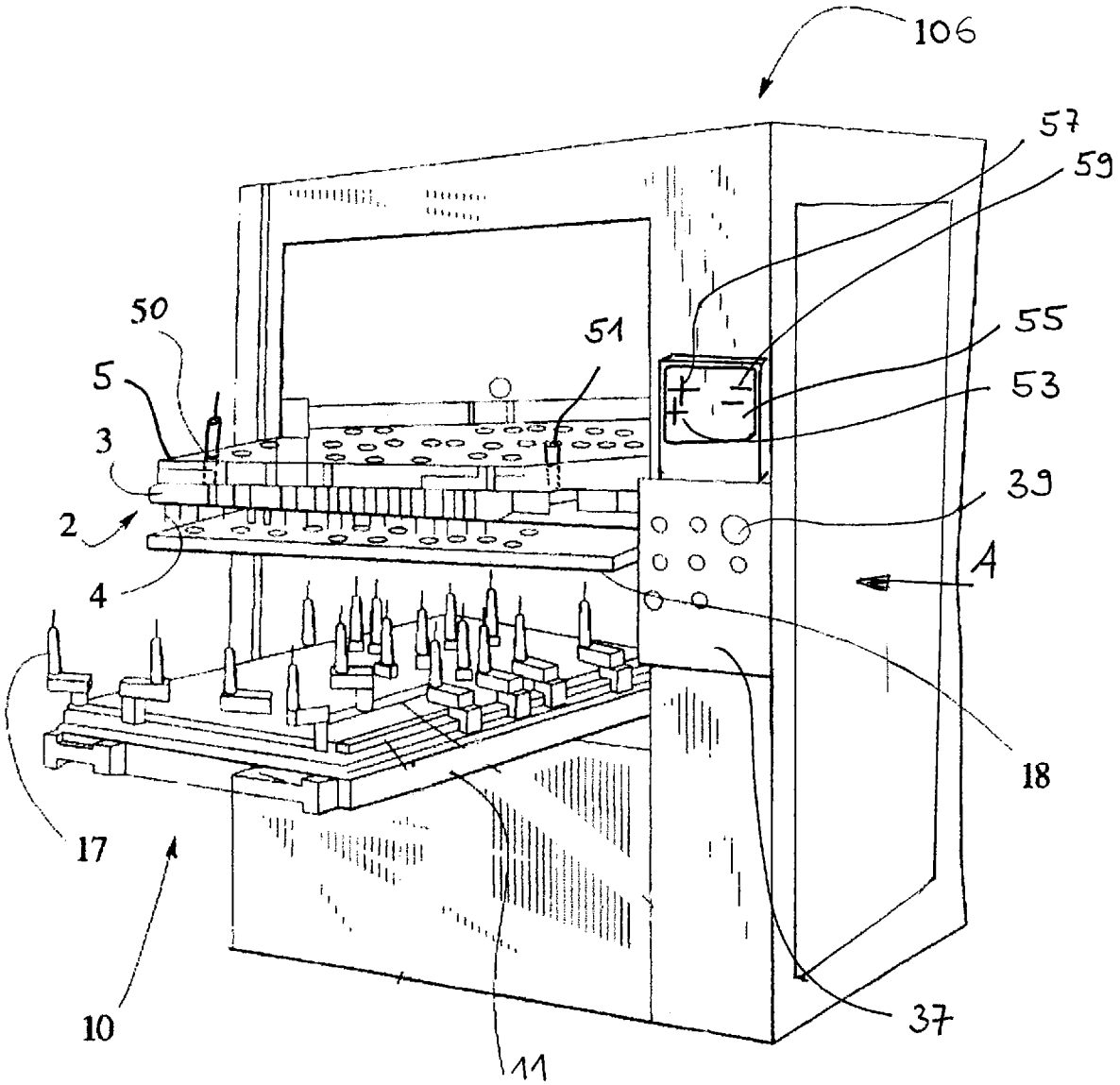
FIG. 2 shows a simplified side view of a variant of the device according to the invention in the form of a stripping station.

By way of example, FIG. 2 illustrates a variant of a stripping device 106 which has an upper changeable tool 2 with a so-called stripping board 3 which has stripping pins 4 attached to it that project downwards.

The upper changeable tool 2 is releasably fastened to a holder 5 for the batch to be processed, the holder 5 being on the device side and illustrated in a simplified fashion. In the illustrated embodiment, the holder 5 is designed in the form of a laterally extensible carriage or sliding frame to which the stripping board 3 is fastened.

In the illustrated embodiment, two lower changeable tools are shown, more specifically a changeable tool 10 in the form of a board from which telescopic pins 17 protrude which project upwards and are in alignment with the stripping pins 4.

Since the provision of the changeable tool 10 is not absolutely necessary, the changeable tool 18 in the form of a stripping plate may be the only lower changeable tool. This stripping plate has openings which are adapted in terms of size and geometry to the die-cutting wastes and are positioned directly below the die-cutting wastes to be separated from the workpiece sheet lying above it. During separation, the tool closes, so that the upper changeable tool 2 travels downwards and the stripping pins 4 and the telescopic pins 17 optionally clamp the die-cutting wastes and eject them downwards through the openings in the stripping plate.

Sheets of different formats or having different blanks always require separate specific changeable tools 2, 10, 18.

The changeable tools 2, 10, 18 need to be inserted into their frame-type carriages, introduced into the device and precisely aligned there with each other and with the sheet.

Figure 3:
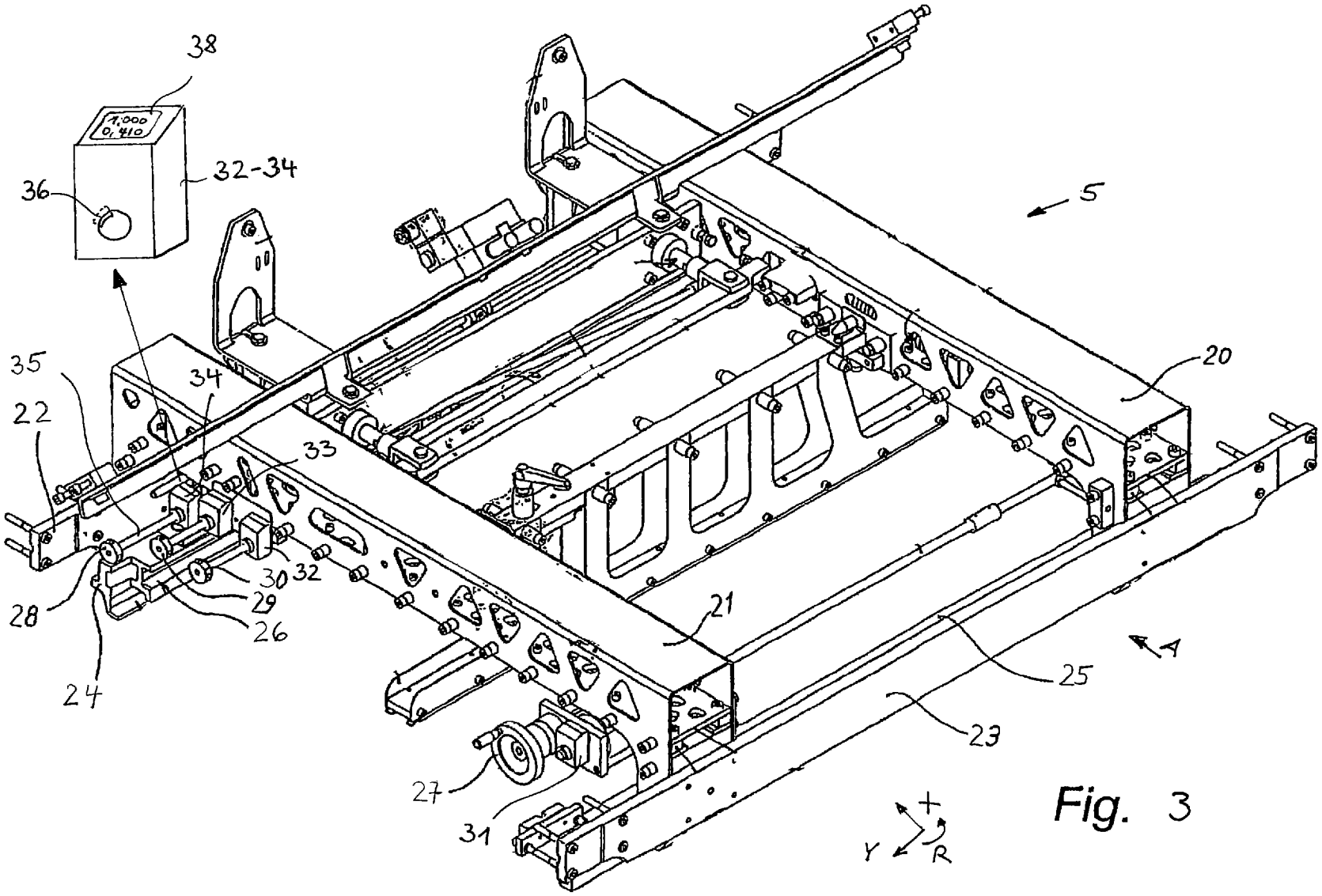
FIG. 3 shows a holder in the form of a sliding frame for the device according to FIG. 2, a variety of changeable tools being adapted to be inserted into the holder.

The holder 5 shown in FIG. 3 is illustrated as an example only; it may also be simpler in configuration. Further, it may also be employed for the changeable tools 10, 18 in a similar design.

The holder 5 comprises a pair of carriers 20, 21 and transverse carriers 22, 23 which form a carrier structure. A front guide 24 and a rear guide 25, illustrated somewhat concealed, are adjustably attached to this carrier structure. The front guide 24 has a receiving groove 26 which extends over essentially the entire length of the guide 24. The rear guide 25 has a corresponding groove which faces the groove 26 and is not visible. The guides 24, 25 can be adjusted as desired by means of toothed racks, linkages and spindles in a plane parallel to the plane of the sheet 122 lying thereunder, namely in an X-direction (direction of the moving sheet), in a Y-direction, i.e. transversely to the X-direction, and in a rotational direction R. In addition, the distance between the guides 24, 25 can be varied by means of an adjustment means 27.

Further adjustment means 28, 29 and 30 serve to align the guides 24, 25 in the X-, Y- and rotational R directions.

The adjustment means 27-30 may be configured to be manual or motor-driven.

Furthermore, sensor units 31-34 may be coupled to the adjustment means 27-30 and are used for detecting the respective positions of the corresponding adjustment means 27-30 and, in this way, the position of the guide 24, 25 or of the parts connected to and moving with it.

Symbolically illustrated is one of the sensor units 31-34, which has a sensor 36 accommodated in its interior and may include a display device 38, here a display.

The sensor units 31-34 are electronically coupled to a control unit 37 of the device or of the entire flat bed die-cutting press. An operating unit is denoted by 39.

For aligning the upper changeable tool 2 with the lower changeable tool, in this case the changeable tool 18, one or two digital cameras 50, 51 is/are provided (see FIG. 2). In the illustrated embodiment, a camera 50 is provided in the front edge area in the feed direction A of the sheet 122 and the camera 51 is provided in the rear edge area of the changeable tool 2 (see FIG. 5).

Figure 4:
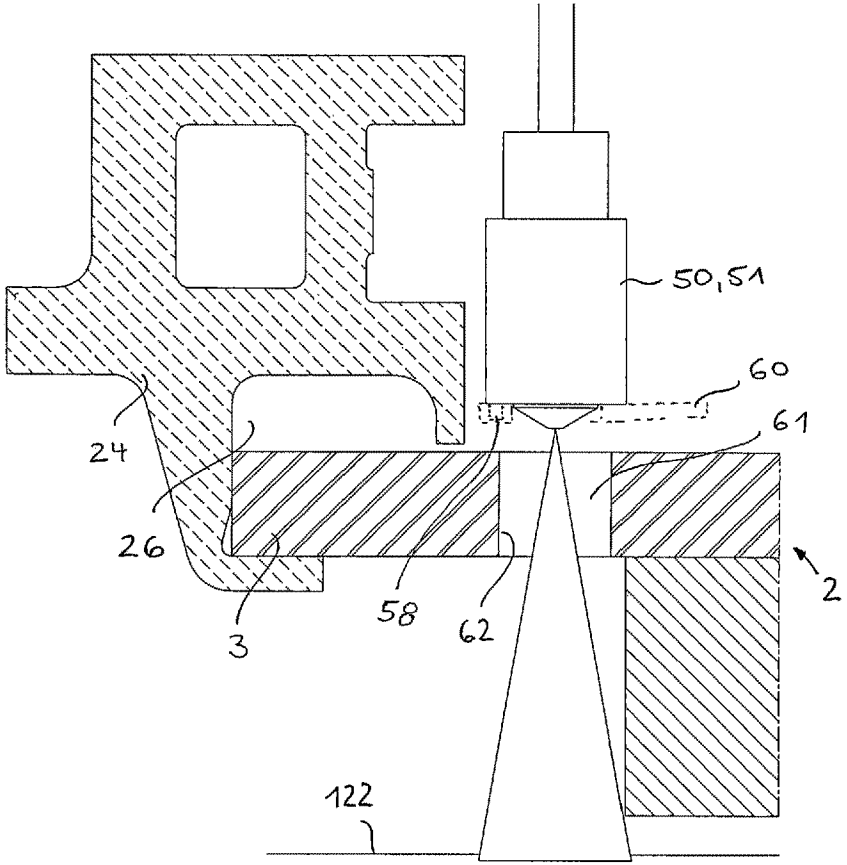
FIG. 4 shows a sectional view of the holder in the region of the upper changeable tool with a variant for the positioning of a camera.

The cameras 50, 51 are coupled to the control unit 37 and may be inserted into the device only for aligning the changeable tools 2, 18. The stripping board 3 may, for example, have appropriate seats or mounting means for positioning the cameras 50, 51 quickly, securely and free of play. As an example, the upper changeable tool 2 has an opening 61 in the stripping board 3 (see FIG. 4) which can be used as a seat for inserting the camera 50 or 51. In an alternative, as shown in FIG. 4, the camera is fixed by a separate retainer 60. The retainer 60 can be temporarily (for the alignment process) or permanently (even during processing) fixed to the device (here: to the die-cutting press). Further, the retainer 60 may allow to displace the camera manually or automatically by motor drives within a plane parallel to the sheet 122 within the station or parallel to the stripping board 3.

The cameras 50, 51 are positioned such that when a sheet 122 has been moved into the device 106, they can detect this sheet, and in the absence of the sheet, they can optically detect the lower changeable tool 18.

Figure 5:
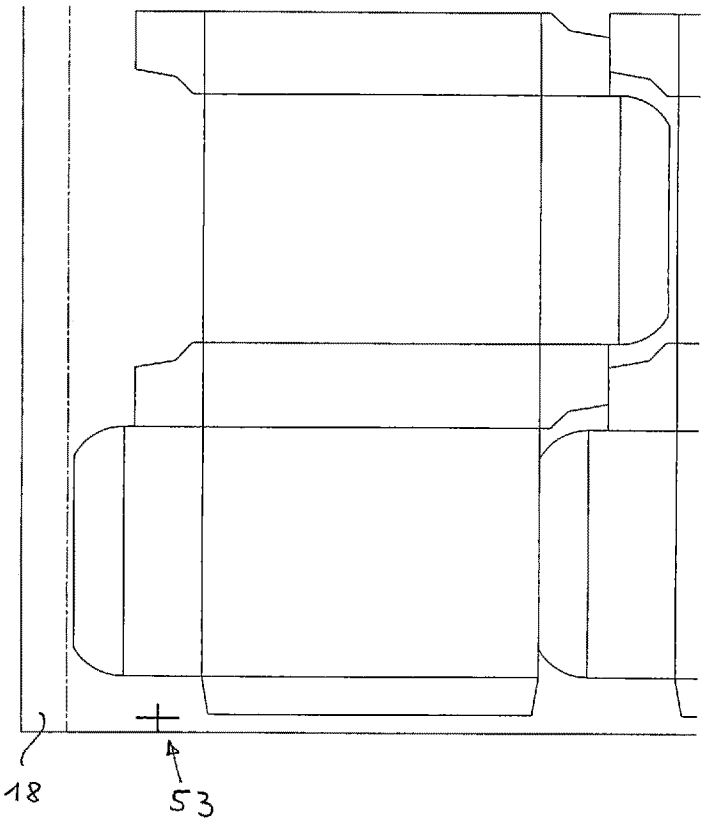
FIG. 5 shows a top view of a sheet that has been moved in, in the region of a longitudinal end.

FIG. 5 illustrates the sheet 122 for setting the upper changeable tool 2 in the area of the section that can be optically captured by the camera 50. It can be seen here that a mark 53 in the form of a cross, for example, has been permanently applied to the top side of the sheet.

Such a mark 53 was also applied to the lower changeable tool 18 inside or outside the device after an optimum alignment of the upper and lower changeable tools 2, 10 with each other, e.g. burnt in using a laser. For example, the mark is precisely aligned with the seat for the camera 50 in the upper changeable tool 2.

The method of aligning the upper and lower changeable tools 2, 10 and 18 will now be described below.

First the lower changeable tool 18, possibly also the changeable tool 10, if necessary, is installed. Subsequently, the upper changeable tool 2 is installed, and a sheet 122 that was previously die-cut in the preceding station is moved into the device 106 by the flat bed die-cutting press.

The sheet 122 may be a test sheet, for example, which has two marks 53, namely, one mark that corresponds to the mark 53 and a second mark in the area below the camera 51. These marks are positioned in a predetermined, fixed allocation to the edges of cut in the sheet 122 that were generated in the preceding station.

Since the sheets can be positioned precisely and repeatably in the device 106 by means of grippers 124 guided through the flat bed die-cutting press by chains 126 (see FIG. 1) and by means of stops, the upper changeable tool 2 and then the lower changeable tool 18 merely have to be aligned with the sheet 122.

This alignment is effected by means of the cameras 50, 51 and a display device (screen 55) that is coupled to the control unit 37 and displays the image captured by the cameras 50, 51. Additionally, a mark 57 for the camera 50 and a mark 59 for the camera 51 are electronically inserted in and shown on the screen 55, which represent the current camera orientation, i.e. the exact center of the camera 50, 51 and its rotational orientation.

In this connection, it is important that the cameras 50, 51 are seated in their retainers repeatably and precisely not only in the radial direction, but also in the direction of rotation. As shown in FIG. 4, to this end the cameras 50, 51 may have eccentric extensions 58 that serve to determine the direction of rotation.

Below the marks 57, 59, the screen 55 displays marks that are within the images of the cameras 50, 51, i.e. the marks on the lower changeable tool 18.

It can be seen that there is a misalignment here, so that the two crosses, just as the two vertical lines in the area of the camera 51, have to be made to register with each other.

Once the upper changeable tool 2 is aligned with the sheet or reference sheet that has been moved in, the sheet is removed and the cameras 50, 51 view the changeable tool 18 below, so that the corresponding marks on the lower changeable tool 18 are now displayed on the screen 55.

The lower changeable tool 18 now has to be aligned with the upper changeable tool 2, which was aligned in an optimum manner previously. It should be emphasized that the reference sheet need not necessarily be provided with a mark of its own. It is also possible to perform the alignment by means of the edges of cut which were generated in the sheet in the preceding die-cutting station.

The changeable tools 2, 10, 18 are aligned either purely manually by rotating the adjustment means 28-30 in the form of wheels as shown in FIG. 3 until the respective marks are exactly superimposed on the screen 55.

Alternatively, when the screen 55 is too far away, the manual alignment may be done using the display devices 38 which are provided on the sensor units 32-34 (see FIG. 2).

The control unit 37 detects the alignment errors using the image data which it has obtained from the cameras 50, 51, and sends corresponding, derived data to the display devices 38, where information is reproduced which indicates to the user the actual misalignment and/or the target position. For example, the target position may be indicated in the display (upper line in the display device 38 in FIG. 3) and the actual position under it. The operator then rotates the adjustment means 28 accordingly until the lower value has reached the upper value. As an alternative to this, the display device 38 may only show an arrow, for example, which indicates a rotation of the adjustment means 28 to the right or to the left as a command. As soon as the target position has been reached, a stop sign may be displayed, for example.

Alternatively, however, the device can also fully automatically align the upper in relation to the lower changeable tool 2, 18, more specifically first the upper and then the lower changeable tool 2 and 18, respectively.

To this end, not only sensor units 32-34 are provided, but also motor-driven adjustment means 28-30, e.g., stepper motors or servomotors. These motors are coupled to the control unit 37, as are the sensor units 32-34.

Using the image information received from the cameras 50, 51, the control unit 37 drives the respective motors until an alignment has been completed. The instantaneous motor position is detected by means of the sensor units 32-34.

After the changeable tools 2, 10, 18 have been aligned, the cameras 50, 51 are removed again, and the flat bed die-cutting press starts to operate.

The cameras 50, 51, however, need not be provided only temporarily for alignment purposes; they may also be accommodated in the device permanently, either in the region of the holder 5 or at the retainer 60 that is fixed to the machine frame, as in indicated in FIG. 4. Here, the upper changeable tool 2 has an opening 61 in the stripping board 3, through which the camera 50, 51 can view the sheet 122 or the lower changeable tool 18. The opening 61 is, for example, positionally oriented in relation to the mark on the lower changeable tool 18 such that they are centered on each other. The camera 50, 51 furthermore captures, for example, the edge 62 of the opening 61, so that it also allows to detect the position of the upper changeable tool 2 by means of the edge 62. Then the circular contour of the edge 62 is reproduced on the screen, for example.

If an additional tool, e.g. tool 10, is to be aligned, tool 18 might be aligned before tool 10 is introduced into the device. Tool 10 is also to be aligned by the cameras. Tool 18 might be provided with marks or might be provided with an opening like opening 61 so as to present an opening edge for sensing by the camera, positioning and aligning. The opening should, however, have an opening area which is smaller than the opening of the upper tool, i.e. changeable tool 3 allowing the camera 50 or 51 to sense both opening edges simultaneously.

Rather than two cameras 50, 51, it is also possible to provide one camera, which then must have a larger angle of view in order to detect marks spaced apart from each other.

Alternatively or additionally to the manual alignment, provision may also be made for a completely autonomous self-alignment. To this end, the control unit is configured to automatically align the holders on the basis of the data received from the at least one camera. The operator may possibly also make a decision by himself/herself as to whether the alignment is to be carried out manually or automatically. If the device effects the alignment only automatically, the display devices may possibly also be dispensed with.

The invention claimed is:

1. A method of aligning an upper changeable tool and a lower changeable tool in a device for processing cardboard or plastic packaging workpiece sheets, the method comprising:

inserting the lower changeable tool into a holder on a device side, the lower changeable tool and the upper changeable tool configured to perform at least a part of the processing;

moving a sheet of the workpiece sheets into the device until the sheet lies above the lower changeable tool;

inserting the upper changeable tool into a holder on the device side releasably inserting at least one camera in a form-fitting seat on the upper changeable tool, aligning the upper changeable tool in relation to the sheet with the aid of the at least one camera;

removing the sheet;

aligning the lower changeable tool in relation to the upper changeable tool with the aid of the at least one camera;

providing the lower changeable tool with at least one mark that is adapted to be detected by the at least one camera, and using the at least one mark as a target position of the lower changeable tool to align with the upper changeable tool.

2. The method according to claim 1, wherein the at least one camera is introduced into the device for a time period of the aligning, and the method further comprises:

removing the camera from the device after the alignment.

3. The method according to claim 1 further comprising:

providing a plurality of the cameras, including the at least one camera, wherein a field of view of a first camera of the cameras covers an area that is a front edge area of the lower changeable tool in the feed direction of the sheet, and a field of view of a second camera of the cameras covers a rear edge area of the lower changeable tool.

4. The method according to claim 1, further comprising attaching the at least one camera to the device at such a distance from the changeable tools that a field of view of the at least one camera covers the upper changeable tool.

5. The method according to claim 4, further comprising attaching the at least one camera to a retainer configured for allowing displacement and alignment of the camera with respect to the upper changeable tool.

6. The method according to claim 4, further comprising:

sensing by the camera an opening in the upper changeable tool for determining the position of the upper changeable tool, and sensing the lower changeable tool through the opening for aligning the upper and the lower changeable tools with respect to each other.

7. The method according to claim 1, wherein the aligning of the upper changeable tool in relation to the sheet comprises identifying marks provided on the sheet or edges, of a cut, produced on the sheet.

8. The method according to claim 1, wherein the aligning is performed with the aid of a display device in the form of a screen that is coupled to the at least one camera and reproduces the image captured by the at least one camera.

9. The method according to claim 8, further comprising loading an electronic mark added to the camera image into the screen to represent the current camera orientation.

10. The method according to claim 8, further comprising:

performing the aligning manually either exclusively by means of the screen or by additionally using digital sensor units which are electronically coupled to the control unit of the device, determining the positions of parts that move during the setting of the associated changeable tool identifying alignment errors via the control unit on the basis of the image information received from the at least one camera, and outputting data for the display of at least one of the current misalignment and the target position to display devices in the form of displays which are integrated in the sensor units.

11. The method according to claim 1, wherein the aligning proceeds fully automatically, wherein the control unit activates motors for adjusting the changeable tools in order to bring the changeable tools into the target position.

12. The method according to claim 1, wherein the method is performed in a flat bed die-cutting device, a flat bed stripping device, an embossing device or a sheet printing device.

13. A device for processing cardboard or plastic packaging workpiece sheets, the device comprising:

a processing station including a transport device for transporting the workpiece sheets through the processing station in succession;

an upper changeable tool and a lower changeable tool, the changeable tools configured for the processing of the workpiece sheets, the changeable tools being configured to be fastened in holders on the device side and to be aligned with each other;

a central electronic control unit for controlling the device;

at least one digital camera coupled to the control unit and mounted in the processing station, such that when a sheet of the workpiece sheets has been moved in, the camera optically detects the sheet and, when the sheet has been moved out, the at least one camera optically detects the lower changeable tool;

an adjustment device for independently aligning the upper and lower changeable tools with each other based on the optical detections; and at least one display device configured to reproduce a current alignment of the sheet that has been moved in, relative to the upper changeable tool and, when the sheet has been moved out, to reproduce the alignment of the lower changeable tool relative to the upper changeable tool;

wherein the upper changeable tool includes a form-fitted seat configured to receive insertion of the at least one digital camera, and the lower changeable tool includes at least one mark configured to be detected by the at least one digital camera and marking a target position of the lower changeable tool aligned in relation to the upper changeable tool.

14. The device according to claim 13, wherein the adjustment device comprises manual adjustment devices.

15. The device according to claim 13, wherein the adjustment device comprises motor-driven adjustment devices which are coupled to the control unit and configured, after a misalignment has been detected, to bring the associated changeable tool into the target position, wherein the control unit is configured to automatically align the holders on the basis of the data received from the at least one camera.

16. The device according to claim 13, further comprising a display device including a screen for reproducing at least one of the camera image(s) and displays provided on sensor units of the adjustment device, wherein the control unit is configured to output on the display device information about at least one of the current position and the relation between the current position and the target position of the changeable tool.

17. A device for processing cardboard or plastic packaging workpiece sheets, the device comprising:

an upper changeable tool and a lower changeable tool, the changeable tools configured for the processing of the workpiece sheets, the changeable tools being configured to be fastened in holders on the device side and to be aligned with each other;

a central electronic control unit for controlling the device;

a digital camera coupled to the control unit and mounted in the processing station, such that when a sheet of the workpiece sheets has been moved in, the digital camera optically detects the sheet and, when the sheet has been moved out, the digital camera optically detects the lower changeable tool;

an adjustment device for independently aligning the upper and lower changeable tools with each other based on the optical detections; and at least one display device configured to reproduce a current alignment of the sheet that has been moved in, relative to the upper changeable tool and, when the sheet has been moved out, to reproduce the alignment of the lower changeable tool relative to the upper changeable tool, wherein the upper changeable tool defines a first opening therethrough, and the digital camera determines the position of the upper changeable tool and optically detects the lower changeable tool through the first opening, wherein the lower changeable tool defines a second opening therethrough, and the second opening has an opening area smaller than the opening area of the first opening so as to align the upper and the lower changeable tools with respect to each other.

18. A device for processing cardboard or plastic packaging workpiece sheets, the device comprising:

an upper changeable tool and a lower changeable tool, the changeable tools configured for the processing of the workpiece sheets, the changeable tools being configured to be fastened in holders on the device side and to be aligned with each other;

a central electronic control unit for controlling the device;

a digital camera coupled to the control unit and mounted in the processing station, such that when a sheet of the workpiece sheets has been moved in, the digital camera optically detects the sheet and, when the sheet has been moved out, the digital camera optically detects the lower changeable tool;

an adjustment device for independently aligning the upper and lower changeable tools with each other based on the optical detections; and at least one display device configured to reproduce a current alignment of the sheet that has been moved in, relative to the upper changeable tool and, when the sheet has been moved out, to reproduce the alignment of the lower changeable tool relative to the upper changeable tool, wherein the upper changeable tool defines a opening therethrough, and the digital camera determines the position of the upper changeable tool and optically detects the lower changeable tool through the opening, wherein the lower changeable tool includes a mark discernible by the digital camera through the opening so as to align the upper and the lower changeable tools with respect to each other.

* * * * *